United States Patent [19]

Vitol

[11] Patent Number: 4,787,158

[45] **Date of Patent: * Nov. 29, 1988**

[54] EASY REMOVAL TAMPER-INDICATING LABEL

[76] Inventor: Matt J. Vitol, 146 E. Court St., Woodstock, Va. 22664

[ * ] Notice: The portion of the term of this patent subsequent to Jun. 9, 2004 has been disclaimed.

[21] Appl. No.: 24,966

[22] Filed: Mar. 12, 1987

Related U.S. Application Data

[63] Continuation-in-part of Ser. No. 768,477, Aug. 22, 1985, Pat. No. 4,671,003.

[51] Int. Cl.[4] ..... A44C 3/00

[52] U.S. Cl. ..... 40/638; 428/191; 156/289

[58] Field of Search ..... 40/2 R, 594; 428/191; 156/289

[56] References Cited

U.S. PATENT DOCUMENTS

| | | | |
|---|---|---|---|
| 2,095,437 | 10/1937 | Fox | 40/2 R |
| 2,170,147 | 8/1939 | Lane | 40/2 R |
| 2,246,984 | 6/1941 | Palmer | 40/2 R |
| 2,845,728 | 8/1958 | Huber | 40/2 R |
| 3,221,427 | 12/1965 | Kaplan | 40/2 R |
| 4,671,003 | 6/1987 | Vitol | 40/2 R |

FOREIGN PATENT DOCUMENTS

| | | | |
|---|---|---|---|
| 2545249 | 11/1984 | France | 40/2 R |

*Primary Examiner*—Robert Peshock
*Assistant Examiner*—J. Hakomaki
*Attorney, Agent, or Firm*—Sixbey, Friedman, Leedom & Ferguson

[57] ABSTRACT

An easy removal pressure-sensitive adhesive-backed label includes a tamper indicator which is especially useful as a pricing label for consumer goods is provided. The label includes nonadhesive finger grip which may be grasped with the fingers to assist in removal of the label from the surface to which it has been applied. The label further includes a score line which causes it to separate completely into two sections, thus bisecting the information on the label, when removal of the label is attempted. Reapplication of the label to another surface, such as might be attempted by an unscrupulous consumer desiring to switch labels, requires precise alignment of the label sections to avoid detection. A method for producing this tamper indicating pressure-sensitive adhesive label which may be readily adapted to conventional laminate production line procedures is also provided.

10 Claims, 2 Drawing Sheets

EASY REMOVAL TAMPER-INDICATING LABEL

This is a continuation-in-part of Ser. No. 768,477 filed Aug. 22, 1985 now U.S. Pat. No. 4,671,003.

TECHNICAL FIELD

The present invention relates generally to signs, labels and other unitary identifying indicia and specifically to an easily removable, pressure-sensitive adhesive tamper-indicating label and to a method for producing such a label.

BACKGROUND ART

Signs, labels, tags and similar identifying indicia of the type which are customarily applied to a surface with pressure sensitive adhesive are being used in increasing numbers by government, industry and private enterprise. Every year, or more frequently, state and local governments issue millions of pressure sensitive labels and tags which are required to be applied to automobiles, boats and other vehicles to evidence payment of registration fees, taxes and the like. Other pressure sensitive signs or labels are increasingly being used to impart a wide variety of information from the name of the manufacturer of a product, to instructions for product use, or to the fact that a motor vehicle or other item has been inspected or approved and to whatever message the buyer desires to put on his or her car bumper. Moreover, the widespread use of such pressure sensitive labels, signs and tags, primarily because of their low cost, is expected to increase to an even greater extent.

Despite the advent of the Uniform Price Code, the use of pressure sensitive price labels by retail stores has increased. Billions of such labels are manufactured and applied to consumer goods annually. The application of pressure sensitive labels to the goods is generally accomplished with ease, although removal from the carrier or backing paper can pose problems. However, when the time comes to remove the price label, removal is generally only accomplished with great difficulty. In the case of price labels in particular, the difficulty of removal is a characteristic purposely chosen to prevent unscrupulous consumers from removing the original price label and replacing it with one containing a lower price. To this end, a very strong pressure sensitive adhesive is used on such labels. However, the vast majority of consumers are not in this category, and are, unfortunately, confronted with the unpleasant task of removing tenacious and stubborn price labels from the goods they have purchased.

Not only is removal of most currently available price labels difficult, but the objects on which they have been placed are also very likely to be damaged during the removal process. If the consumer's fingernails are not long enough to scrape the label off, some type of scraper or the like will be used to assist in removing the stubborn label, usually at considerable risk of harm to the object's surface. Alternatively, the consumer may choose to use a solvent to facilitate label removal which, again, poses a significant risk of damaging the object bearing the label. The consumer, therefore, is faced with two equally unappealing courses of action: attempting label removal with its attendant aggravation and frustration and the likelihood of damage to the goods he has purchased or leaving the label in place on the goods. Neither choice, however, is an acceptable one if the item purchased was intended to be given as a gift. Social convention has never and still does not sanction the giving of gifts which are either damaged or reveal the price paid for the time. Moreover, a consumer who has experienced the annoyance which accompanies product damage caused by removal of a pressure sensitive price label is likely to shop at retail outlets which employ other methods of pricing.

Consequently, there is a need for a label for application to consumer goods which meets the needs of both the merchant, who wants a price label which cannot be readily removed and exchanged for one containing a lower price prior to purchase, and the consumer, who wants a price label which can be easily removed without damage after the item has been purchased. Moreover, such a label should be easily and inexpensively manufactured and applied to consumer goods using conventional equipment.

One type of price label currently available is dispensed from a hand-held printer directly onto the goods to be marked. Such labels are often scored in a crisscross pattern so that, when removal is attempted, the label will tear into several pieces. A label of this type clearly deters label exchanging. It cannot be reapplied to another item removal of this label in one piece is virtually impossible. Although a label of this type may discourage would-be label switchers from defrauding retail stores, it still presents removal problems to the consumer and, consequently, does not avoid the product damage discussed above.

The pressure sensitive adhesive signs, labels and tags disclosed in the prior art suitable for use in pricing consumer goods are clearly not intended to be easily removed and do not include tamper indicating means. U.S. Pat. Nos. 2,636,297 to Johnson and 3,706,626 to Smith et al. illustrate a type of pressure sensitive label commonly used as price label on consumer goods. The label disclosed in the Smith et al. patent has pressure sensitive adhesive applied to the entire back of the label, while the label disclosed in the Johnson patent has a strip of pressure sensitive adhesive applied to most of the label surface. Neither label, however, is easily removed from the surface to which it has been applied without the likelihood of damaging that surface. Moreover, to the extent that removal of the label disclosed in the Johnson patent is facilitated by the absence of adhesive from the label edges, Johnson does not provide tamper-indicating structure which would discourage label removal by dishonest parties.

There are disclosed in the prior art labels which do include means to facilitate their removal from the surface to which they have been applied. The label shown in U.S. Pat. No. 3,421,239 to Smith is exemplary of such labels. While structures such as the tab shown in the Smith patent may assist in label removal, the excess material required to produce such tabs results in inefficiencies, wasted material and, hence, increased cost in the production of labels including them. Moreover, these tabs or projections are susceptible of tearing and render the labels difficult to produce or apply on conventional label making and applying equipment.

A sticker contemplated for temporary application is disclosed in U.S. Pat. No. 4,055,249 to Kojima. This sticker, however, is formed of a complex, multi-layer arrangement of sticking sheets specially cut to form lugs or tabs which project beyond the body of the sticker to provide a structure which can be grasped with the fingers to remove the sticker. Additionally, a series of several manufacturing steps is required to form this multilayer arrangement. There is, moreover, no suggestion that the potentially costly sticker unit described in this reference could include tamper indicating structure which would make it difficult to remove or reapply. Further, the label structure described in this reference is not readily adaptable for production on and application by conventional equipment.

U.S. Pat. No. 4,557,505 to Schaeffer et al. discloses a tamper indicating tape product. However, this product requires that stress such as would accompany the opening of a container be applied to it to produce a color change which causes a first message to be changed to a second message. Not only is there no suggestion that this tape product could be used as a price label, but production on the multi-layer laminate required to communicate that tampering had occurred would be costly and not readily adapted to conventional label making equipment.

The prior art, therefore, fails to disclose a tamper indicating label which may be removed from a surface without damaging the surface, but which discourages unauthorized label removal and reapplication, and which may be produced inexpensively on conventional label making equipment and applied readily with conventional label application equipment.

SUMMARY OF THE INVENTION

It is, therefore, a primary object of the present invention to provide a tamper indicating label which may be produced and applied with conventional labeling equipment and which may be removed without damage from the surface to which it has been applied.

It is another object of the present invention to provide a pressure sensitive adhesive-backed label which includes at least one integral, self-contained easily identified finger grip means located completely within the perimeter of the label whereby the label may be easily removed from the surface to which it has been applied without damage to the surface.

It is another object of the present invention to provide a pressure sensitive adhesive-backed label including tamper indicating means for indicating unauthorized removal of the label from a first surface and its reapplication to a second surface.

It is a further object of the invention to provide a pressure sensitive adhesive-backed pricing label for application to consumer goods including a line of weakening which bisects the label to separate the label into two sections for indicating removal and reapplication of the label and at least one pair of easily identified finger grip means located completely within the perimeter of each section of the label to assist the consumer in removing the label from the goods.

It is yet another object of the present invention to provide a method for producing a readily removable pressure sensitive adhesive-backed label including the creation of at least one finger grip means which is completely contained within the perimeter of the label.

It is still another object of the present invention to provide a method for producing an easily removable, pressure sensitive adhesive-backed label which minimizes material waste.

It is a further object of the present invention to provide a low-cost, efficient method for producing an easily removable pressure sensitive adhesive-backed label which may be employed with only minimal modification of existing production line equipment.

It is yet a further object of the present invention to provide a method for producing a pressure sensitive adhesive-backed pricing label for consumer good including tamper indicating means for indicating unauthorized removal and reapplication of the label and a pair of easily identified finger grip means located completely within the perimeter of the label to assist the consumer in removing the label from the goods.

The present invention provides a label which is especially suitable for use as a pricing label for consumer goods. The label includes finger grip means whereby the label may be removed from the goods by the consumer after purchase without damage to the surface where the label was applied. Moreover, the label of the present invention also includes tamper indicating means which indicate the unauthorized removal of the label from one surface and the subsequent reapplication of the label to another surface. The present invention includes a sheet which has a first, information-receiving surface and a second, adhesive-receiving surface opposite the first surface. At least one, and preferably at least two, nonadhesive zones located completely within the outer perimeter of the label are provided on the second surface to form finger grip means. The second, adhesive-receiving surface is laminated to a release-coated backing paper. Identifying indicia is applied to the first surface to mark the location of the nonadhesive zone and thereby assist consumers to locate the nonadhesive zones prior to removal of the label. Tamper indicating means are provided on the first surface to cause the label to separate completely into two sections, each of which includes a finger grip means, when label removal is attempted so that reapplication of the label requires precise alignment of the two sections. The present invention additionally provides a method for producing a pressure sensitive adhesive-backed label having a first, information-receiving surface and a second, adhesive-receiving surface and including a pair of nonadhesive zones positioned within the perimeter of the label to form finger grip means and tamper indicating means to indicate the unauthorized removal and subsequent reapplication of the label. The method of the present invention includes the steps of providing a first sheet having at least one surface characterized by low adhesion, perforating the first sheet at a plurality of predetermined points to form a predetermined pattern of perforations, providing a second sheet including a first, information-receiving surface and a second, adhesive-receiving surface, applying a pressure-sensitive adhesive to the adhesive-receiving surface of the second sheet, laminating the low adhesion surface of the perforated first sheet to the second surface of the second sheet to create a laminate having a plurality of exposed adhesive zones, neutralizing the adhesive on the second surface in the area of the perforations to create a plurality of nonadhesive zones, marking the first surface of the second sheet to locate the nonadhesive zones, applying information to the information-receiving surface of the second sheet, scoring the first surface in a predetermined pattern to create lines of weakening which bisect the information, and cutting the laminated first and second sheets according to a predetermined pattern to form a plurality of labels, each of which includes a line of weakening and at least one nonadhesive zone within the perimeter thereof.

Other objects and advantages will be apparent from the following description, claims and drawings.

BEST MODE FOR CARRYING OUT THE INVENTION

Labels, and particularly retail store pricing labels, currently in use are almost exclusively the pressure sensitive adhesive-backed type. Such labels are often printed and then applied to consumer goods with a hand-held printing and dispensing device such as those presently sold by Pitney-Bowes, Monarch and others. The present invention provides both a pressure sensitive adhesive-backed label including finger grip means to facilitate its removal and tamper indicating means to indicate the unauthorized removal and reapplication of the label and a method for producing such a label. The labels contemplated by the present invention will take a variety of forms, and the examples discussed herein are intended to be illustrative and are not intended to be limiting in any way. Additionally, although the term "label" is used throughout to designate the information-conveying medium with which the present invention is employed, the term "label" is intended to include tags, signs, "stickers", "bumper stickers" and similar information-conveying media.

Figure 1:
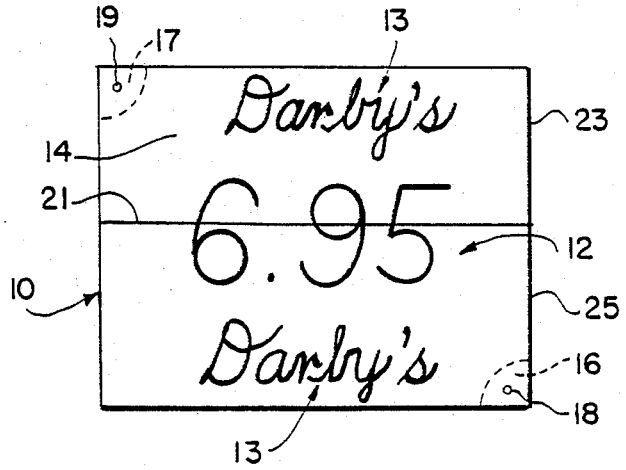
FIG. 1 is a top view of one configuration of a label produced in accordance with the present invention.

Referring to the drawings, FIG. 1 illustrates, in top view, one embodiment of a label 10 manufactured in accordance with the present invention. The label 10 has a generally rectangular configuration, although any geometric or irregular shape desired may be employed. The selection of a regular, geometric configuration, however, substantially reduces material waste during production and, therefore, reduces the cost of each label. Since most retain pricing labels are desirably rectangular in shape and about 10 mm by 19 mm in size so that they may be applied with the hand-held label application apparatus referred to above, this configuration and size are preferred for the present invention. Identifying indicia, such as price information 12 and the retail store name 13, are shown printed on the top surface 14 of the label 10. The opposite lower surface, as will be described in more detail hereinbelow, includes a layer of pressuresensitive adhesive which covers the entire lower surface of the label except for nonadhesive areas or zones 16 and 17 indicated by the dashed outline in the upper left corner and the lower right corner of label 10. Zones 16 and 17 function as finger grips as will be explained in detail hereinbelow. Markers 18 and 19 are preferably provided within the nonadhesive zones 16 and 17 to assist in locating the positions of the zones. The markers 18 and 19 may take a variety of forms. It is preferred to use a hole having a diameter of about 1/64 inch, such as would be made by a punch. A marker of this type is sufficiently small and unobtrusive that it does not interfere with the information contained on the label, but can still be seen by the person who must remove the label.

The exact size and location of the nonadhesive zones 16 and 17 will depend in large measure upon the shape and the size of the label 10. The most effective location of zones 16 and 17 on a rectangular label has been found to be at opposite corners. The size or area of zones 16 and 17 relative to the area of the label does not have to be very large and, in some applications, should be as small as possible. A sufficiently large nonadhesive zone must be provided to serve as a finger grip and thus enable the person removing the label to grasp the edge of the label with the fingers and pull it away from the surface on which it has been applied. The nonadhesive zones 16 and 17 are located completely within the outside perimeter of the label 10 and would also be located completely within the perimeter of a label having any other configuration.

Label 10 further includes tamper indicating means in the form of a score line 21 which bisects the label in the area of a price information 12. The score line 12 is a line of weakening which penetrates the sheet forming label 10 to a depth which causes the label to separate into two sections 23 and 25 upon an attempted removal of the label from the surface to which it has been applied. Each section 23 and 25 would then contain a portion of the price or other information on the label. A dishonest consumer seeking to defraud the retail establishment by substituting the label of FIG. 1 with a lower price for the original higher price label of FIG. 1 would find his or her task extremely difficult. Although, as explained in further detail hereinbelow, removal of the present label is greatly facilitated by the provision of nonadhesive finger grips (zones 16 and 17), reapplication of the label once it had been removed would require the exact alignment of the price or other information on the two label sections 23 and 25 so that the label looked like it had been applied to the item originally. Misalignment of the label sections should be obvious to the store's sales clerks or cashiers and would indicate that the label had been tampered with.

The structure of the label of the present invention makes label transfer or label switching very difficult. The erstwhile label switcher, while standing, would be required to hold one article, remove the label, one section at a time, pick up a second article and apply the removed label sections to the second article so that the price information was precisely aligned. He would then have to remove the original label from the second article, one section at a time, and affix it to the first article so that it was properly aligned, all the while subjecting himself to the scrutiny of others because of the suspicious nature of his actions. Accurate transfer and alignment of two sections of a removed label would be difficult under the best of conditions. Since the typical retail store does not provide the seating facilities or desks required to achieve optimum alignment of label sections, the would-be defrauder will find himself in a situation where his fraud will be readily detected.

Figure 2:
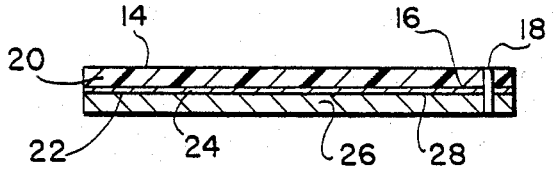
FIG. 2 is a cross-sectional view of the label of FIG. 1.

FIG. 2 illustrates the label 10 of FIG. 1 in cross-section, where it can be seen that label 10 includes multiple layers. Label 10 includes a film or sheet 20 having a top surface 14, which receives information such as that displayed at 12 and 13 in FIG. 1, and a bottom surface 22, which receives a layer 24 of a pressure-sensitive adhesive. The adhesive layer 24 covers all of surface 22. However, in zones 16 and 17, the adhesive has been neutralized as described hereinbelow. Until the label 10 is actually applied to its intended surface, the pressure-sensitive adhesive is protected by a backing sheet 26. The surface 28 of the backing sheet 26 which covers adhesive layer 24 is provided with a release-type coating (not shown), such as silicone, so that this surface is characterized by low adhesion, and the label 10 may be readily removed from the backing sheet 26. The markers 18 and 19, which locate the nonadhesive zones 16 and 17, will assist the user of the label in locating the finger grips and removing the label from the backing sheet 26. The label of the present invention may be modified for use in currently available hand-held labeling equipment so that the backing sheet is removed as the label is applied to the surface of an item of consumer goods. In that case, the markers 18 and 19 will assist the consumer in locating the nonadhesive finger grips 16 and 17 so that they can be gripped with the fingers to remove the label sections 23 and 25 from the item.

Currently available consumer goods price labels employ a pressure sensitive adhesive characterized by very high tack. One reason for using such a high tack adhesive is to make the labels difficult to remove, thereby discouraging label switching by unscrupulous consumers. However, the use of a high tack adhesive makes label removal equally difficult for the honest consumer who has purchased the goods. In addition, this high tack adhesive causes presently available labels to adhere tenaciously to the surfaces they have been applied to, with the result that complete removal of the label requires tools and/or chemicals which damage the goods bearing the label. The present label design allows the use of a pressure sensitive adhesive layer 24 having a significantly lower tack than that used on current price labels. Consequently, the likelihood of damage to the goods bearing the label can be substantially eliminated by the present label design. Any of a number of available pressure sensitive adhesives having an appropriate tack could be employed in the label of the present invention.

The lables of the present invention can be made from a variety of materials, although paper is preferred for pricing labels because of its relatively low cost. Plastic films, such as MYLAR® (polyester), polyvinylchloride, acetate, methylmethacrylate and polycarbonate, are also particularly suitable for use in different applications of the invention. They can be transparent or colored, and the surfaces of these films will accept both printing and the application of a pressure-sensitive adhesive. Suitable backing papers which may be laminated to such adhesive-backed films to protect the adhesive prior to application of signs formed from these films are known in the laminating art. Any suitable film or backing paper which achieves the objectives sought by the present invention could be used to form the removable labels described herein.

The present invention further includes a method for producing the labels described above. The creation of at least one nonadhesive zone and preferably two on each label like zones 16 an 17 and the mass production of a large number of adhesive-backed labels laminated to a backing sheets is efficiently achieved according to the method of the present invention. This method is described with reference to FIGS. 3 and 4.

Figure 3:
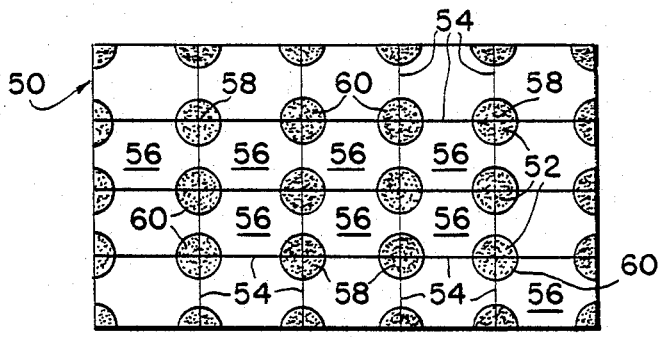
FIG. 3 is a top view of a backing sheet perforated according to the method of the present invention.

Pressure-sensitive product laminates typically consist of a film or web that is coated with a suitable pressure-sensitive adhesive and a backing or laminate sheet which is generally paper and one side of which is characterized by low adhesive attraction. Often a release-type coating, such as silicone, is applied to the backing paper to achieve the low adhesion characteristics. FIG. 3 illustrates such a backing or laminate sheet 50. The backing sheet 50 is perforated at a plurality of regular intervals. The size, spacing and locating of perforations 52 will vary, depending upon the ultimate configuration and size chosen for the labels to the produced. A circular or elliptical perforation is preferred, however, for rectangular labels. For purposes of illustration, the present method will be described as it relates to the production of a rectangular label, such as that shown in FIG. 1. The same method may be effectively employed to produce a circular, elliptical or even a pretzel-shaped label. This method, moreover, can be adapted easily to large or small scale production equipment. In the production of a label of rectangular configuration, the backing sheet 50 can be marked with a series of intersecting parallel lines, such as lines 54 forming the grid shown in FIG. 3. The rectangular areas 56 outlined by the lines 54 correspond to the ultimate dimensions of the plurality of labels which may be obtained from each sheet. It will be apparent that the production of a rectangular label results in the least waste of material; however, the production of other shapes of removable labels according to this process also results in less waste than do prior art processes.

Perforations 52 are positioned substantially symmetrically about the point of intersection 58 of four adjacent rectangles 56 so that each perforation 52 removes a portion of the corner 60 of each rectangle 56. The perforations 52 may be made in the backing sheet 50 on conventional high speed machinery currently employed for perforating business forms, paper towels and the like.

Figure 4:
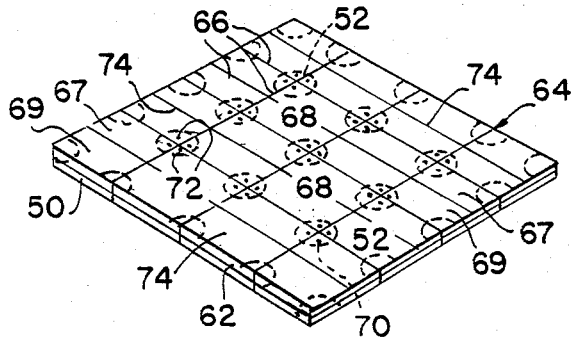
FIG. 4 is a top perspective view of a perforated backing sheet and an adhesive-receiving sheet laminated according to the present invention and including a plurality of labels of a single configuration.

One surface of the plastic film paper or other material 62 from which the label is to be made is coated with pressure sensitive adhesive appropriate for the ultimate application of the label according to conventional methods which are well known in the art, and the backing sheet 50, perforated as described, is then laminated to the adhesive-coated film 62 to form the laminate 64 shown in FIG. 4. Perforations 52, indicated in dashed lines in FIG. 4, do not extend through the film 62, but expose areas of the adhesive-coated surface of film 62.

Following the lamination of backing sheet 50 to the adhesive-coated film 62, the laminate is subjected to an adhesive neutralization step, whereby the adhesive-containing areas on film 62 which are exposed by the prefo-rations 52 in the backing sheet 50 are treated to render them nonadhesive. A particularly effective and efficient way to achieve this objective is to apply an adhesive-neutrailizing material to the backing sheet side of the laminate 64 so that the adhesive-neutralizing material contacts the adhesive on film 62 in the area of each perforation 52. Any material capable of neutralizing the adhesive coated on film 62 may be used for this purpose. A dry powder, however, is the preferred form for the adhesive-neutralizing material. One particularly effective adhesive-neutralizing material, which is also very low in cost, is powdered talc, A readily available inexpensive form of magnesium silicate. The talc can be easily applied to the perforations on the backing sheet by a variety of methods, such as, for example, dusting by means of impregnated pads, by rollers, by the application of controlled puffs of talc or by wipe on - wipe off techniques. Other, similar, adhesive-neutralizing materials, such as silica or pulverized charcoal, may also be employed. However, any material which could be used in the process described herein to effectively neutralize the adhesive in a pressure-sensitive laminate is contemplated for use with the present invention. Moreover, the addition of the described adhesive-neutralizing step to conventional laminating processes can be achieved with only minimal changes in production line equipment.

The application of the talc or other suitable material creates a plurality of nonadhesive areas or zones which are defined by the circumferences of perforations 52 on the adhesive-coated surface of sheet 62. When the laminate 64 is cut along lines 66 to form a plurality of rectangular labels 68 as shown in FIG. 4, each rectangle has a nonadhesive zone 70 in at least one corner and preferably in two opposite corners. Nonadhesive zone 70 in FIG. 4 corresponds to the nonadhesive zone 16 of label 10 in FIG. 1. The nonadhesive zone thus created provides a finger grip or lifting point for the finished label which will remain nonadhesive for the lift of the label. The nonadhesive zones serve not only as finger grips to assist the user in removing the label from its backing paper and to place it in the exact location selected, but also to aid the user in removing the label from that location with relative ease and without tools or chemicals.

A predetermined pattern of score lines, such as lines 74 in FIG. 4, which ultimately bisect each label into two sections are then formed in the laminate 64. The score lines create lines of weakening which should desirably penetrate the sheet 62 a sufficient distance to cause each individual label 68 to separate into sections 67 and 69, which correspond to sections 23 and 25 in FIG. 1, along these lines of weakening when a nonadhesive finger grip (70) is grasped. However, the score lines 74 should not be so deep that the label separates into two sections upon removal from the backing sheet 50. Conventional label making equipment can be employed for this purpose.

Prior to cutting the laminate sheet 64, the sheet may be printed by silk-screening or other suitable processes so that each label contains whatever information, identifying indicia or the like desired. However, if the labels are intended for use in a hand-held pricing label printer and applicator, this step may be omitted. Also, prior to cutting the laminate sheet 64 into individual labels, a suitable marker may be applied to the sheet to mark the precise location of the nonadhesive zone 70 on each label. This may be accomplished by punching the laminate at points 72 in FIG. 4. A punch which leaves a hole about 1/64 inch in diameter has been found to be especially suitable for this purpose. The arrangement shown in FIG. 4 lends itself particularly well to the use of a machine tool which includes four such punches to punch simultaneously markers 72 in the nonadhesive zones 70 of four labels 68. The markers 72 in FIG. 4 correspond to markers 18 and 19 in FIG. 1. If film 62 is transparent or light in color, the nonadhesive area 70 may be simultaneously created and marked by using talc which has been tinted or a naturally dark adhesive-neutralizing material, such as pulverized charcoal.

The printed and punched laminate sheet 64 is then cut along lines 66 to form the finished labels 68. The number of labels which can be obtained from each laminate sheet, such as sheet 64, will depend upon such factors as the size of the laminate sheet and the size and configuration of the finished labels printed on the sheet.

It will be noted that the method described and shown in conjunction with FIGS. 3 and 4 results in a finished label 68 with a nonadhesive finger grip 70 in each corner. Although a label produced accordingly will be somewhat easier and less costly to manufacture, it may be desired to modify the perforation pattern or to mask all or part of the perforated areas 52 during the adhesive-neutralization step to produce a label having two oppositely situated nonadhesive finger grips, such as shown in FIG. 1.

Figure 5:
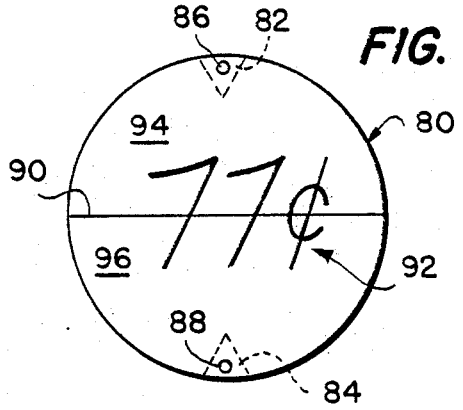
FIG. 5 is a top view of a second configuration of a label produced according to the present invention.

FIG. 5 illustrates a second configuration of a pressure sensitive adhesive-backed label 80 produced according to the present invention. Label 80 has a circular configuration and includes wedge-shaped nonadhesive finger grips 82 and 84, the locations of which are indicated by markers 86 and 88. A score line 90 bisects the label 80 and the price information 92 so that the label will separate into two sections 94 and 96. It can be readily seen from FIG. 5 that precise alignment of label sections 94 and 96 so that the price information 92 is also exactly aligned would require extreme care under even the most ideal conditions.

Figure 6A:
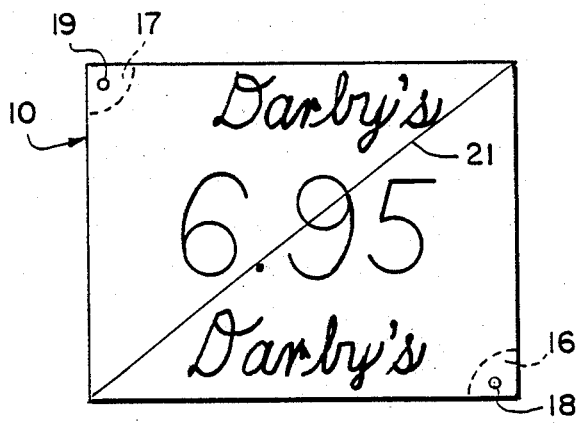
FIGS. 6*a* and 6*b* are top views of the labels of FIGS. 1 and 5 showing a second configuration of tamper indicating means.
Figure 6B:
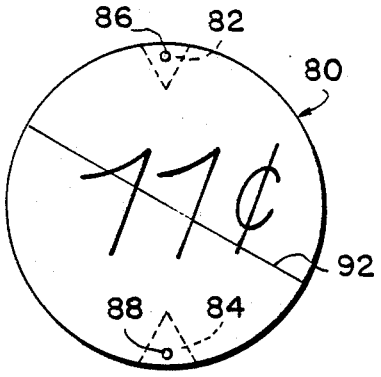

FIGS. 6A and 6B illustrate the labels 10 and 80 of FIGS. 1 and 5, respectively, showing a second configuration of the tamper indicating score lines 21 and 90. In each case, the score lines 21 and 90 bisect labels 10 and 80 diagonally with respect to the locations of the nonadhesive finger grips to create lines of weakening separating each label into two sections when label removal is attempted. The price information on each label is also bisected so that the reapplication of the label sections so that this information is in perfect alignment would be extremely difficult. Other locations and shapes of tamper indicating score lines could also be employed for the same purpose. For example, a conventional straight scoring knife such as would be used to form score lines 21 and 90 could be replaced by one having a wavy, jagged or zig-zag pattern, which would render the alignment of removed label sections even more difficult.

INDUSTRIAL APPLICABILITY

The label of the present invention will find its primary application as a price label for consumer goods. However, it may be used to form any type of pressure sensitive adhesive-backed label, sign, tag or the like wherein it is desired to prevent or discourage the unauthorized removal of the label from one surface and its reapplication to another surface.

I claim:

1. A tamper indicating label for removable application to a substrate including a first sheet having a first, information-conveying surface and a second adhesive-receiving surface opposite said first surface, a layer of pressure-sensitive adhesive adjacent to and completely covering said second surface, finger grip means on said second surface for grasping the edge of the label immediately interior of and adjacent to the perimeter of the label comprising a zone where the adhesive has been neutralized to render the zone nonadhesive, marking means on said first surface for marking the location of said finger grip means, tamper indicating means for indicating the unauthorized removal and reapplication of the label to the substrate, and a second backing sheet including a low adhesion portion in mating contact with the adhesive layer of the first sheet.

2. The label described in claim 1, wherein said tamper indicating means includes score line means bisecting said first surface of said first sheet into two sections comprising a line of weakening in said first sheet which causes said label to separate completely into two sections along said line of weakening when the label is pulled from the substrate.

3. The label described in claim 2, wherein each of said two sections includes finger grip means.

4. A method for producing an easy removal tamper indicating pressure-sensitive adhesive label including the steps of:

(a) providing a first sheet having at least one surface characterized by low adhesion;

(b) perforating said first sheet to form a plurality of perforations arranged in a predetermined pattern in said sheet, wherein each of said perforations has a predetermined configuration;

(c) providing a second sheet having a first, information-conveying surface and a second, adhesive-receiving surface opposite said first surface;

(d) applying a layer of pressure-sensitive adhesive to said second surface of said second sheet;

(e) laminating said first sheet to said second surface of said second sheet to form a laminate so that said perforations expose adhesive-containing zones on the first sheet side of said laminate;

(f) neutralizing the adhesive in said adhesive-containing zones to form nonadhesive zones;

(g) scoring the first surface of said first sheet in a predetermined pattern to create lines of weakening therein; and (h) cutting said laminate to form a plurality of labels, each of said labels including a line of weakening and at least two nonadhesive zones contained within the perimeter thereof.

5. The method described in claim 4, further including the step of applying a marker to said laminate to mark the location of each of said nonadhesive zones in each of said labels.

6. The method described in claim 4, further including the step of applying information to said first, information-receiving surface of said second sheet.

7. The method described in claim 4, wherein said adhesive is neutralized by applying an adhesive-neutralizing material to each of said adhesive-containing zones.

8. The method described in claim 7, wherein said adhesive-neutralizing material is in the form of a powder.

9. The method described in claim 8, wherein said adhesive-neutralizing material is selected from the group consisting of magnesium silicate, charcoal and silica.

10. The method described in claim 9, wherein said adhesive-neutralizing material is magnesium silicate.

* * * * *